US011566577B2

(12) United States Patent
von der Ehe

(10) Patent No.: US 11,566,577 B2
(45) Date of Patent: Jan. 31, 2023

(54) COMPRESSION MONITORING SYSTEM FOR A RECIPROCATING ENGINE

(71) Applicant: INNIO Waukesha Gas Engines Inc., Waukesha, WI (US)

(72) Inventor: James Kristopher von der Ehe, Oconomowoc, WI (US)

(73) Assignee: Innio Waukesha Gas Engines Inc., Waukesha, WI (US)

( * ) Notice: Subject to any disclaimer, the term of this patent is extended or adjusted under 35 U.S.C. 154(b) by 5 days.

(21) Appl. No.: 17/163,901

(22) Filed: Feb. 1, 2021

(65) Prior Publication Data

US 2022/0243679 A1 Aug. 4, 2022

(51) Int. Cl.

| | |
|---|---|
| ***F02D 41/22*** | (2006.01) |
| ***F02D 35/02*** | (2006.01) |
| ***F02D 41/14*** | (2006.01) |

(52) U.S. Cl.

CPC ..... *F02D 41/22* (2013.01); *F02D 35/023* (2013.01); *F02D 35/027* (2013.01); *F02D 41/1498* (2013.01)

(58) Field of Classification Search

CPC ..... F02D 41/22; F02D 35/023; F02D 35/027; F02D 41/1498

See application file for complete search history.

(56) References Cited

U.S. PATENT DOCUMENTS

| | | | | |
|---|---|---|---|---|
| 4,744,243 | A * | 5/1988 | Tanaka | F02P 17/02 73/114.28 |
| 4,944,271 | A * | 7/1990 | Iwata | F02D 41/1497 123/406.41 |
| 6,923,046 | B2 * | 8/2005 | von Glowczewski | G01M 15/08 73/35.12 |
| 8,342,011 | B2 * | 1/2013 | Galtier | F02D 41/1497 73/114.16 |
| 8,429,955 | B2 | 4/2013 | Taglialatela Scafati et al. | |
| 2004/0050363 | A1 * | 3/2004 | Yamaoka | B60W 10/10 123/436 |
| 2004/0194754 | A1 * | 10/2004 | Yamaoka | F02D 41/008 123/295 |
| 2005/0045156 | A1 * | 3/2005 | Yokoi | F02D 17/02 123/481 |
| 2005/0229903 | A1 * | 10/2005 | Kobayashi | F02D 41/38 123/568.21 |

(Continued)

*Primary Examiner* — Kurt Philip Liethen
(74) *Attorney, Agent, or Firm* — Fletcher Yoder, P.C.

(57) ABSTRACT

A compression monitoring system for a reciprocating engine includes a controller configured to terminate combustion within a combustion chamber of the reciprocating engine while a crankshaft of the reciprocating engine is rotating. The controller is also configured to receive an input signal from a sensor indicative of vibration within a cylinder extending from the combustion chamber while the crankshaft is rotating and the combustion is terminated. Furthermore, the controller is configured to determine a magnitude of the vibration within a frequency range and to determine a maximum pressure within the cylinder based on the magnitude of the vibration within the frequency range. The controller is also configured to output an output signal indicative of the maximum pressure within the cylinder and/or control operation of the reciprocating engine based on the maximum pressure within the cylinder.

20 Claims, 4 Drawing Sheets

(56) References Cited

U.S. PATENT DOCUMENTS

| | | | | |
|---|---|---|---|---|
| 2007/0209637 | A1* | 9/2007 | Damitz | F02D 41/40 701/105 |
| 2009/0043475 | A1* | 2/2009 | Buslepp | F02D 35/023 73/114.15 |
| 2009/0183551 | A1* | 7/2009 | Fattic | F02D 35/023 73/23.31 |
| 2010/0162803 | A1* | 7/2010 | Scafati | G01L 23/225 73/114.26 |
| 2012/0150414 | A1* | 6/2012 | Huang | F02D 41/28 701/101 |
| 2013/0211694 | A1* | 8/2013 | Taglialatela | F02P 5/1502 701/105 |
| 2014/0172280 | A1* | 6/2014 | Ogata | F02D 35/027 701/111 |
| 2015/0285710 | A1* | 10/2015 | Akazaki | F02D 35/024 73/114.16 |
| 2016/0245210 | A1* | 8/2016 | Sasaki | G01L 27/007 |
| 2017/0003190 | A1* | 1/2017 | Nandigama | F02D 35/027 |
| 2017/0051699 | A1* | 2/2017 | Batal | G01M 15/11 |
| 2017/0212000 | A1* | 7/2017 | Duchemin | G01L 23/226 |
| 2018/0171915 | A1* | 6/2018 | Suzuki | F02N 99/006 |
| 2018/0283299 | A1* | 10/2018 | Kondo | F02D 41/2467 |
| 2019/0162158 | A1* | 5/2019 | Zurlo | F02D 41/1497 |
| 2020/0003145 | A1* | 1/2020 | Sugano | F02D 35/028 |
| 2021/0140387 | A1* | 5/2021 | Jin | F02D 41/403 |

* cited by examiner

COMPRESSION MONITORING SYSTEM FOR A RECIPROCATING ENGINE

BACKGROUND

The present disclosure relates generally to a compression monitoring system for a reciprocating engine.

Reciprocating engines generally include one or more cylinders and a piston disposed within each cylinder. Each piston is coupled to a crankshaft by a connecting rod. In addition, certain reciprocating engines include at least one intake valve and at least one exhaust valve for each cylinder. The intake valve(s) are configured to control the flow of a fuel/air mixture into the cylinder, and the exhaust valve(s) are configured to control the flow of exhaust out of the cylinder. In certain reciprocating engines, each piston compresses the fuel/air mixture within the cylinder after the fuel/air mixture is provided to the cylinder by the intake valve(s). Effectively compressing the fuel/air mixture prior to ignition increases the efficiency of the reciprocating engine.

However, after extended operational use of the engine, the compression within at least one cylinder may be reduced due to formation of undesirable flow path(s) (e.g., leaks) at the cylinder(s). For example, worn piston rings may enable fluid flow between the piston and the cylinder, worn valve(s) and/or valve seat(s) may enable fluid flow through the valve(s) while the valve(s) are closed, or a worn head gasket may enable fluid to flow between the engine block and the head. Reduced compression may be identified during an inspection of the engine. For example, the spark plug(s) may be removed, a pressure sensor may be coupled to each spark plug opening, and the crankshaft may be driven to rotate while the pressure sensor(s) monitor the pressure within the cylinder(s). Accordingly, this inspection process may be significantly time-consuming. As a result, operation of the engine may be interrupted for a significant period of time.

BRIEF DESCRIPTION

In certain embodiments, a compression monitoring system for a reciprocating engine includes a controller having a memory and a processor. The controller is configured to terminate combustion within a combustion chamber of the reciprocating engine while a crankshaft of the reciprocating engine is rotating. The controller is also configured to receive an input signal from a sensor indicative of vibration within a cylinder extending from the combustion chamber while the crankshaft is rotating and the spark generation and/or the fuel flow is terminated. Furthermore, the controller is configured to determine a magnitude of the vibration within a frequency range and to determine a maximum pressure within the cylinder based on the magnitude of the vibration within the frequency range. The controller is also configured to output an output signal indicative of the maximum pressure within the cylinder and/or control operation of the reciprocating engine based on the maximum pressure within the cylinder.

DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments.

Figure 1:
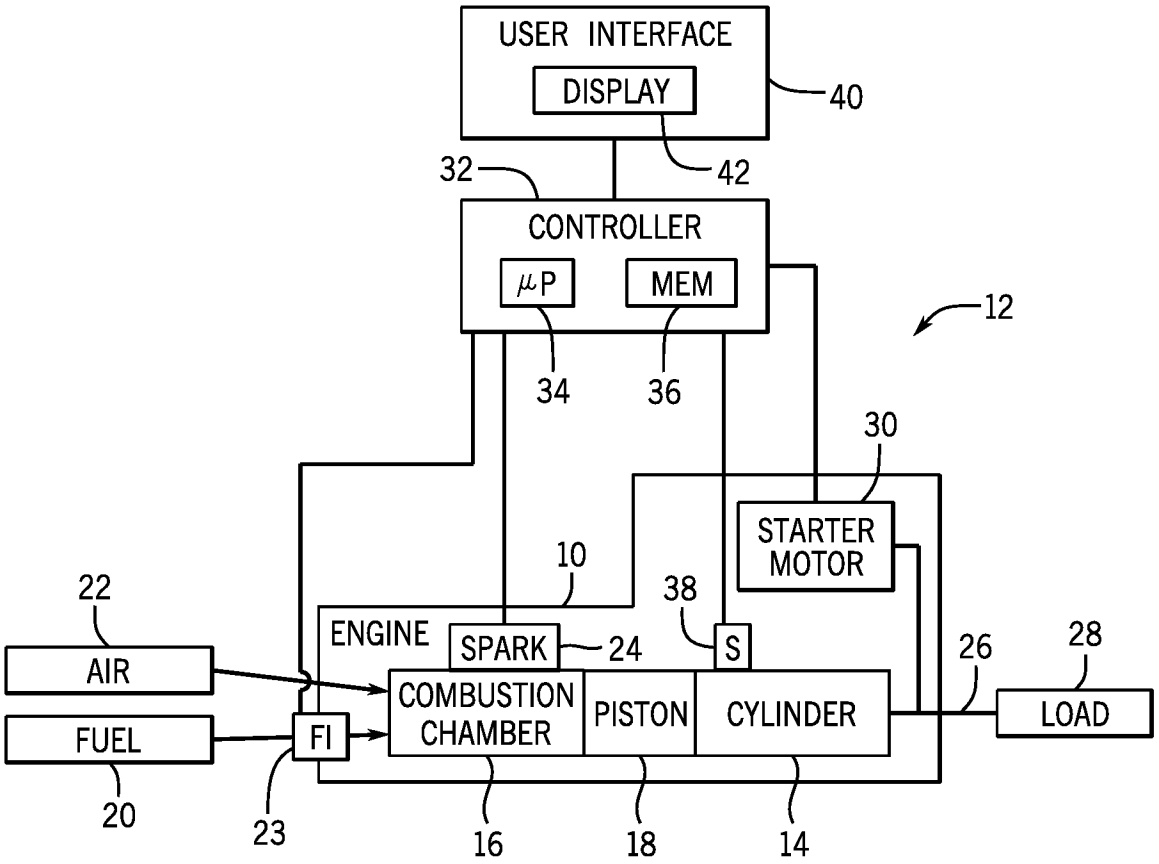
FIG. 1 is a block diagram of an embodiment of a reciprocating engine and an embodiment of a compression monitoring system.

FIG. 1 is a block diagram of an embodiment of a reciprocating engine 10 and an embodiment of a compression monitoring system 12. In the illustrated embodiment, the reciprocating engine 10 includes one or more cylinders 14. For example, the reciprocating engine 10 may include 1, 2, 3, 4, 5, 6, 8, 10, 12, 14, 16, 18, 20, or more cylinders 14. A combustion chamber 16 is positioned adjacent to each cylinder 14, and a piston 18 is disposed within each cylinder 18. Each combustion chamber 16 is configured to receive fuel 20 and air 22. During operation of the reciprocating engine 10, fuel 20 and air 22 are provided to each combustion chamber 16, thereby forming a fuel/air mixture. The fuel/air mixture may be controlled by a fuel injector 23 that controls a flow rate of the fuel 20 into the respective combustion chamber 16. For example, the reciprocating engine 10 may include one fuel injector 23 for each combustion chamber 16. A spark source 24 (e.g., spark plug) ignites the fuel/air mixture, thereby inducing combustion of the fuel/air mixture. The combustion generates expanding exhaust gasses that drive the piston 18 away from the respective combustion chamber 16 within the respective cylinder 14. The reciprocating engine 10 may include one or more spark sources 24 (e.g., 1, 2, 3, 4, or more) for each combustion chamber 16. As discussed in detail below, the linear motion of each piston 18 drives a crankshaft 26 to rotate. In the illustrated embodiment, the crankshaft 26 is coupled to a load 28, which is powered by rotation of the crankshaft 26. For example, the load 28 may be any suitable device that may receive a rotational input, such as an electrical power generator, a pump, a wheel of a vehicle, another suitable device, or a combination thereof. In addition, a starter motor 30 (e.g., electric starter motor) may be selectively coupled to the crankshaft 26 during start-up of the reciprocating engine 10 to drive the crankshaft 26 to rotate during the reciprocating engine start-up process.

The reciprocating engine 10 disclosed herein may be adapted for use in stationary applications (e.g., in industrial power generating engines) or in mobile applications (e.g., in cars or aircraft). In certain embodiments, the inner diameter of each cylinder 14 and/or the outer diameter of each piston 18 may be between about 13.5 cm and about 34 cm. By way of further example, the inner diameter of each cylinder 14 and/or the outer diameter of each piston 18 may be between about 10 and about 40 cm, between about 15 and about 25 cm, or about 15 cm. The reciprocating engine 10 may generate power ranging from 10 kW to 10 MW. In some embodiments, the reciprocating engine 10 may operate at less than approximately 1800 revolutions per minute (RPM). In some embodiments, the reciprocating engine 10 may operate at less than approximately 2000 RPM, 1900 RPM, 1700 RPM, 1600 RPM, 1500 RPM, 1400 RPM, 1300 RPM, 1200 RPM, 1000 RPM, 900 RPM, or 750 RPM. In some embodiments, the reciprocating engine 10 may operate between about 750 and about 2000 RPM, between about 900 and about 1800 RPM, or between about 1000 and about 1600 RPM. Exemplary reciprocating engines 10 may include Waukesha Engines (e.g., Waukesha VGF, VHP, APG, 275GL), for example. Exemplary reciprocating engines 10 may also include Jenbacher Engines (e.g., Jenbacher Type 2, Type 3, Type 4, Type 6, Type 9), for example.

The compression monitoring system 12 is configured to monitor the compression within at least one cylinder 14 of the engine. As used herein, "compression" refers to the maximum pressure within the cylinder 14 during the compression stroke of the piston 18 (e.g., while the piston 18 is at top dead center within the cylinder 14). In the illustrated embodiment, the compression monitoring system 12 includes a controller 32 communicatively coupled to the fuel injector(s) 23, to the spark source(s) 24 (e.g., via electrical circuitry, such as transformer(s), etc.), and to the starter motor 30. In certain embodiments, the controller 32 is an electronic controller having electrical circuitry configured to determine the compression of each cylinder 14. In the illustrated embodiment, the controller 32 includes a processor, such as the illustrated microprocessor 34, and a memory device 36. The controller 32 may also include one or more storage devices and/or other suitable components. The processor 34 may be used to execute software, such as software for determining the compression of each cylinder 14, and so forth. Moreover, the processor 34 may include multiple microprocessors, one or more "general-purpose" microprocessors, one or more special-purpose microprocessors, and/or one or more application specific integrated circuits (ASICs), or some combination thereof. For example, the processor 34 may include one or more reduced instruction set (RISC) processors.

The memory device 36 may include a volatile memory, such as random access memory (RAM), and/or a nonvolatile memory, such as read-only memory (ROM). The memory device 36 may store a variety of information and may be used for various purposes. For example, the memory device 36 may store processor-executable instructions (e.g., firmware or software) for the processor 34 to execute, such as instructions for determining the compression of each cylinder 14, and so forth. The storage device(s) (e.g., nonvolatile storage) may include ROM, flash memory, a hard drive, or any other suitable optical, magnetic, or solid-state storage medium, or a combination thereof. The storage device(s) may store data, instructions (e.g., software or firmware for determining the compression of each cylinder 14, etc.), and any other suitable data.

In the illustrated embodiment, the compression monitoring system 12 includes a knock sensor 38. For example, the compression monitoring system 12 may include one knock sensor 38 for each cylinder 14. Each knock sensor 38 is communicatively coupled to the controller 32 and configured to output a sensor signal indicative of vibration within the respective cylinder 14. Each knock sensor 38 may include any suitable type of sensor configured to monitor vibration, such as a piezoelectric sensor, among other suitable type(s) of sensor(s). During operation of the reciprocating engine 10, the controller 32 or other suitable device may identify undesirable detonation within the reciprocating engine 10 based on feedback from the knock sensor(s) 38.

To determine the compression of each cylinder 14 within the reciprocating engine 10, the controller 32 may terminate combustion within the respective combustion chamber 16 by terminating spark generation within the respective combustion chamber 16 and/or by terminating fuel flow into the respective combustion chamber 16 while the crankshaft 26 is rotating. For example, the controller 32 may terminate spark generation by terminating operation of the respective spark source(s) 24. In addition, the controller 32 may terminate fuel flow by terminating operation of the respective fuel injector 23. As used herein, "terminate" refers to stopping operation of a component/engine/process that is in operation and not initiating operation/blocking operation of a component/engine/process that is not in operation. As a result of terminating combustion (e.g., by terminating operation of the spark source(s) 24 and/or by terminating operation of the fuel injector 23), the piston 18 within the respective cylinder 14 is not driven to move by combustion of the fuel/air mixture. However, while combustion is terminated (e.g., while the operation of the spark source(s) 24 and/or the fuel injector 23 is terminated), the respective piston 18 may be driven to move within the respective cylinder 14 via rotation of the crankshaft 26 (e.g., during startup or shutdown of the reciprocating engine).

The controller 32 is configured to receive a sensor/input signal from each knock sensor 38 indicative of vibration within the respective cylinder 14 while the crankshaft is rotating and the combustion is terminated (e.g., at least for the respective cylinder 14). The controller 32 is configured to determine a magnitude of the vibration within a frequency range (e.g., between about 0 Hz and about 100 Hz, between about 0 Hz and about 50 Hz, between about 0 Hz and about 25 Hz, or between about 0 Hz and about 10 Hz). For example, the controller 32 may determine the magnitude of the vibration within the frequency range (e.g., maximum magnitude within the frequency range, average magnitude within the frequency range, etc.) using a fast Fourier transformation (FFT) or any other suitable technique. The controller 32 is also configured to determine a maximum pressure within the respective cylinder 14 based on the magnitude of the vibration within the frequency range (e.g., based on a table, an empirical formula, another suitable relationship, or a combination thereof). Furthermore, the controller 32 is configured to output an output signal indicative of the maximum pressure within the respective cylinder 14. As previously discussed, while combustion is terminated (e.g., while operation of the spark source(s) 24 and/or the fuel injector 23 is terminated), the maximum pressure occurs during the compression stroke of the respective piston 18

(e.g., while the respective piston 18 is at top dead center within the respective cylinder 14). Accordingly, the maximum pressure corresponds to the compression within the respective cylinder 14. The process of receiving the sensor/input signal, determining the magnitude of vibration, determining the maximum pressure, and outputting the output signal may be repeated (e.g., sequentially or concurrently) for each respective cylinder 14 of the reciprocating engine.

In certain embodiments, the controller may terminate combustion (e.g., by terminating the spark generation and/or the fuel flow) for all of the combustion chambers/cylinders of the reciprocating engine concurrently to facilitate determination of the compression within all of the cylinders. However, in other embodiments, the controller may only terminate combustion for a portion of the combustion chambers/cylinders, and the controller may determine the compression within each cylinder within the portion (e.g., sequentially or concurrently). For example, the controller may terminate combustion (e.g., by terminating the spark generation and/or the fuel flow) for a single combustion chamber/cylinder (e.g., while the reciprocating engine remains in operation). The controller may then determine the compression within the single cylinder via the process disclosed above.

The compression monitoring process may be performed during startup of the reciprocating engine, during shutdown of the reciprocating engine, in response to operator input, during operation of the reciprocating engine, or a combination thereof. For example, during startup of the reciprocating engine 10, the controller 32 may output a control signal to the starter motor 30 to drive the crankshaft 26 to rotate, thereby driving each piston 18 to move (e.g., oscillate) within the respective cylinder 14. The controller 32 may also terminate combustion for each combustion chamber 16 (e.g., by terminating spark generation within the combustion chamber 16 and/or by terminating fuel flow into the combustion chamber 16) while the crankshaft 26 is rotating. For each cylinder, the controller 32 may receive the sensor/input signal from the respective knock sensor 38 indicative of vibration within the cylinder, determine a magnitude of the vibration within a frequency range, determine a maximum pressure within the cylinder based on the magnitude, and output an output signal indicative of the maximum pressure. After the compression monitoring process is complete, the controller 32 may initiate spark generation and fuel flow for each combustion chamber/cylinder while the starter motor 30 is driving the crankshaft 26 to rotate, thereby starting the reciprocating engine 10.

By way of further example, during shutdown of the reciprocating engine 10, the controller 32 may terminate combustion within each combustion chamber (e.g., by terminating spark generation within the combustion chamber 16 and/or by terminating fuel flow into the combustion chamber 16). The momentum of the crankshaft 26 may cause the crankshaft 26 to continue rotating (e.g., until internal friction within the reciprocating engine 10 terminates the rotational motion of the crankshaft 26). For each cylinder, while the crankshaft 26 is rotating, the controller 32 may receive the sensor/input signal from the respective knock sensor 38 indicative of vibration within the cylinder, determine a magnitude of the vibration within a frequency range, determine a maximum pressure within the cylinder based on the magnitude, and output an output signal indicative of the maximum pressure.

Furthermore, the compression monitoring process may be performed in response to operator input. For example, while the reciprocating engine 10 is not in operation, an operator may perform the compression monitoring process to determine the compression of each cylinder. For example, the controller 32 may output a control signal to the starter motor 30 to drive the crankshaft 26 to rotate, thereby driving each piston 18 to move (e.g., oscillate) within the respective cylinder 14. The controller 32 may also terminate combustion within each combustion chamber 16 (e.g., by terminating spark generation within the combustion chamber 16 and/or by terminating fuel flow into the combustion chamber 16) while the crankshaft 26 is rotating. For each cylinder, the controller 32 may receive the sensor/input signal from the respective knock sensor 38 indicative of vibration within the cylinder, determine a magnitude of the vibration within a frequency range, determine a maximum pressure within the cylinder based on the magnitude, and output an output signal indicative of the maximum pressure.

In certain embodiments, the controller 32 may determine the compression of one or more cylinders during operation of a multi-cylinder reciprocating engine. For example, while the reciprocating engine is in operation, the controller 32 may terminate combustion within one or more combustion chambers 16 (e.g., sequentially or concurrently). For each cylinder extending from a combustion chamber in which combustion is terminated, the controller 32 may receive the sensor/input signal from the respective knock sensor 38 indicative of vibration within the cylinder, determine a magnitude of the vibration within a frequency range, determine a maximum pressure within the cylinder based on the magnitude, and output an output signal indicative of the maximum pressure. After the compression monitoring process for each cylinder is complete, the controller 32 may initiate spark generation and fuel flow for the respective combustion chamber/cylinder.

In the illustrated embodiment, the compression monitoring system 12 includes a user interface 40 communicatively coupled to the controller 32. The user interface is configured to provide information to an operator of the reciprocating engine 10 and/or receive input from the operator. For example, the user interface may include one or more input devices (e.g., button(s), switch(es), knob(s), mouse, keyboard, etc.) and/or one or more output device(s) (e.g., light(s), speaker(s), gauge(s), etc.). In the illustrated embodiment, the user interface 40 includes a display 42 configured to present visual information to the operator. In certain embodiments, the display may include a touchscreen interface configured to receive input from the operator. In certain embodiments, the controller 32 is configured to output the output signal indicative of the maximum pressure of each respective cylinder 14 to the user interface 40, and the user interface may present a visual indication (e.g., on the display 42) of the maximum pressure(s). Additionally or alternatively, the controller 32 may output the output signal to another suitable device/system (e.g., a remote monitoring/control system, a remote computer system, etc.).

In certain embodiments, the controller 32 may compare the maximum pressure within each cylinder 14 to a threshold pressure. For example, the threshold pressure may correspond to a minimum compression associated with efficient operation of the reciprocating engine 10. The controller may then output a second output signal indicative of instructions to inform the operator and/or terminate operation of the reciprocating engine 10 in response to determining that the maximum pressure is below the threshold pressure. For example, in response to determining that the maximum pressure within a cylinder 14 is less than the threshold pressure, the controller 32 may output the second output signal to the user interface 40, and the user interface 40 may inform the operator that the maximum pressure is less than the threshold pressure (e.g., via a visual indication on the display 42). Additionally or alternatively, in response to determining that the maximum pressure within a cylinder 14 is less then the threshold pressure, the controller 32 may output the second output signal to each fuel injector 23 and to each spark source 24 indicative of instructions to terminate operation of the reciprocating engine (e.g., to terminate fuel flow into the respective combustion chamber 16 and to terminate spark generation within the respective combustion chamber 16). As a result, if the compression monitoring process is performed during startup of the reciprocating engine, the startup process may be terminated. In addition, if the compression monitoring process is performed during shutdown of the reciprocating engine and/or in response to operator input, subsequent startup of the reciprocating engine may be blocked. Furthermore, if the compression monitoring process is performed during operation of the reciprocating engine, operation of the reciprocating engine may be stopped. While a single threshold pressure is disclosed above, in certain embodiments, the controller may output an output signal indicative of instructions to inform the operator in response to determining that the maximum pressure is below a first threshold pressure, and the controller may output an output signal indicative of instructions to terminate operation of the reciprocating engine in response to determining that the maximum pressure is below a second threshold pressure (e.g., in which the second threshold pressure is lower than the first threshold pressure).

In certain embodiments, the controller 32 is configured to compare the maximum pressure of each cylinder (e.g., at least one cylinder) to one or more previously determined maximum pressures for the cylinder to identify a trend. In such embodiments, the controller 32 is configured to output a second output signal indicative of instructions to inform the operator and/or to terminate operation of the reciprocating engine in response to the trend exceeding a threshold maximum pressure variation. The threshold maximum pressure variation may include a maximum slope of a maximum pressure/sample line (e.g., a linear curve fit of the maximum pressure samples). For example, if the maximum pressure is decreasing faster than the threshold maximum pressure variation over multiple samples, the controller may output the second output signal to the user interface 40, and the user interface 40 may inform the operator that the trend exceeds the threshold maximum pressure variation (e.g., via a visual indication on the display 42). Additionally or alternatively, if the maximum pressure is decreasing faster than the threshold maximum pressure variation over multiple samples, the controller 32 may output the second output signal to each fuel injector 23 and to each spark source 24 indicative of instructions to terminate fuel flow into the respective combustion chamber 16 and to terminate spark generation within the respective combustion chamber 16, thereby terminating operation of the reciprocating engine 10. While a single threshold maximum pressure variation is disclosed above, in certain embodiments, the controller may output an output signal indicative of instructions to inform the operator in response to the trend exceeding a first threshold maximum pressure variation, and the controller may output an output signal indicative of instructions to terminate operation of the reciprocating engine in response to the trend exceeding a second threshold maximum pressure variation (e.g., in which the second threshold maximum pressure variation is greater than the first threshold maximum pressure variation).

Furthermore, in certain embodiments, the controller 32 is configured to compare the maximum pressures of the cylinders to one another to identify a deviation. In such embodiments, the controller 32 is configured to output the second output signal indicative of instructions to inform the operator and/or to terminate operation of the reciprocating engine in response to the deviation exceeding a threshold maximum pressure deviation. In certain embodiments, the deviation may be determined by comparing the maximum pressure within each cylinder to an average maximum pressure among the cylinders of the reciprocating engine. In other embodiments, the deviation may be determined by comparing a largest maximum pressure among the cylinders to a smallest maximum pressure among the cylinders. While a single threshold maximum pressure deviation is disclosed above, in certain embodiments, the controller may output an output signal indicative of instructions to inform the operator in response to the deviation exceeding a first threshold maximum pressure deviation, and the controller may output an output signal indicative of instructions to terminate operation of the reciprocating engine in response to the deviation exceeding a second threshold maximum pressure deviation (e.g., in which the second threshold maximum pressure deviation is greater than the first threshold maximum pressure deviation).

In certain embodiments, the controller 32 is configured to control operation of the reciprocating engine 10 based on the maximum pressure within at least one cylinder 14. For example, the controller 32 may control operation of the reciprocating engine based on the maximum pressure within the cylinder(s) by adjusting at least one engine operation parameter for subsequent or current operation of the reciprocating engine. The at least one engine operation parameter may include a timing of the spark generation, a flow rate of fuel into the respective combustion chamber (e.g., as controlled by the respective fuel injector 23), a lift and/or a duration of intake valve(s) and/or exhaust valve(s) of the respective cylinder 14, a throttle setting (e.g., as controlled by a throttle body), or a combination thereof. For example, if the compression monitoring process is performed during startup of the reciprocating engine, the engine operation parameter(s) may be adjusted for the immediately proceeding engine operation. In addition, if the compression monitoring process is performed during shutdown of the reciprocating engine and/or in response to operator input, the engine operation parameter(s) may be adjusted for the subsequent engine operation (e.g., operation of the reciprocating engine the next time the reciprocating engine is started). Furthermore, if the compression monitoring process is performed during operation of the reciprocating engine, the engine operation parameter(s) may be adjusted during operation of the reciprocating engine. In certain embodiments, the engine operation parameter(s) may be adjusted based on a determined maximum pressure for a single cylinder (e.g., the smallest determined maximum pressure, etc.) or based on determined maximum pressures for multiple cylinders (e.g., based on an average of the determined maximum pressures, etc.). The adjusted engine operation parameter(s) may be the same for each cylinder (e.g., based on the determined maximum pressure for a single cylinder, etc.), or the adjusted engine operation parameter(s) may vary among the cylinders (e.g., the engine operation parameter(s) for each cylinder may be adjusted based on the determined maximum pressure of the respective cylinder). Furthermore, in certain embodiments, the controller may adjust the engine operation parameter(s) in response to determining that the maximum pressure within at least one cylinder is below a threshold pressure. While controlling the reciprocating engine by adjusting engine operation parameter(s) is disclosed above, the controller may (e.g., additionally or alternatively) control operation of the reciprocating engine in any other suitable manner (e.g., by adjusting the manner in which certain parameter(s) are determined, by controlling the load coupled to the reciprocating engine, etc.).

Because the compression monitoring system 12 is configured to determine the compression within each cylinder 14 based on feedback from the respective knock sensor 38, the compression may be monitored without physically modifying the reciprocating engine 10 (e.g., by removing the spark plug(s) and installing pressure sensor(s)). As a result, interruption in operation of the reciprocating engine may be substantially reduced or eliminated. In addition, because the compression may be monitored during startup of the engine, during shutdown of the engine, during operation of the engine, or a combination thereof, the compression of each cylinder may be determined more frequently than a compression monitoring process in which the engine is physically modified (e.g., by removing the spark plug(s) and installing pressure sensor(s)). Accordingly, a compression trend may be determined for each cylinder that may enable the operator or the controller to control operation of the engine based on the compression trend. Furthermore, because the compression monitoring system 12 is configured to determine the compression within each cylinder 14 based on feedback from the respective knock sensor 38, the controller may determine the compression of each cylinder without a pressure input, thereby improving operation of the controller. In addition, pressure sensor(s) may be obviated, thereby reducing the cost of the reciprocating engine/monitoring system. While the controller is configured to receive the input signal indicative of the vibration within each cylinder from a respective knock sensor in the illustrated embodiment, in other embodiments, another suitable vibration monitoring sensor (e.g., alone or in addition to the respective knock sensor) may be coupled to the reciprocating engine at/proximate to the respective cylinder. In such embodiments, the controller may receive the input signal from the other vibration monitoring sensor (e.g., alone or in combination with the input signal from the respective knock sensor).

Figure 2:
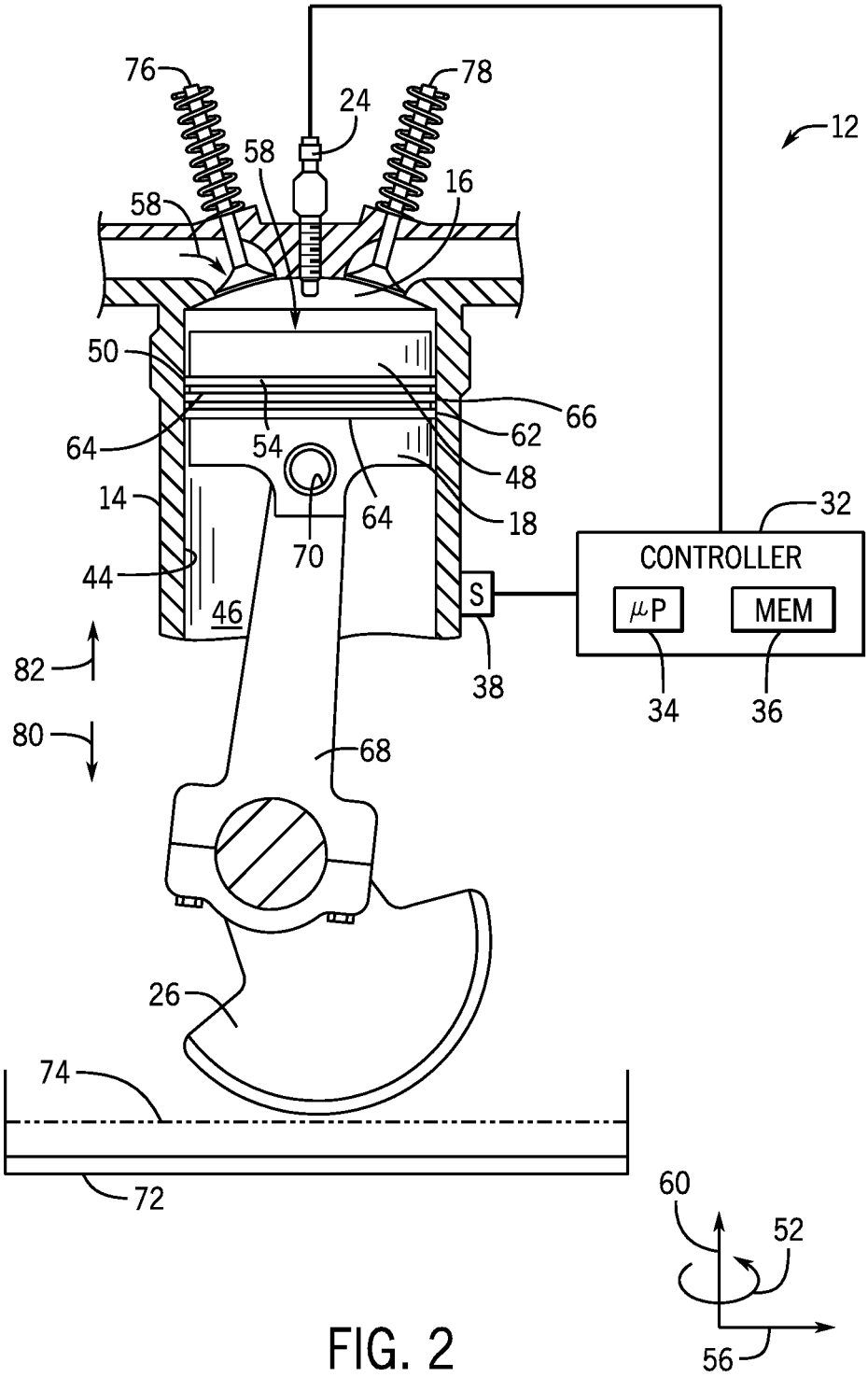
FIG. 2 is a cross-sectional view of an embodiment of a cylinder that may be employed within the reciprocating engine of FIG. 1.

FIG. 2 is a cross-sectional view of an embodiment of a cylinder 14 that may be employed within the reciprocating engine of FIG. 1. As illustrated, the cylinder 14 has an inner annular wall 44 defining a cylindrical cavity 46 (e.g., bore), and the piston 18 is disposed within the cylindrical cavity 46. The piston 18 includes a top portion 48 (e.g., top land), and a top annular groove 50 (e.g., top groove, top-most groove, or top compression ring groove) extends circumferentially (e.g., in a circumferential direction 52) about the piston 18. A top ring 54 (e.g., a top piston ring or a top compression ring) is disposed within the top groove 50.

The top ring 54 is configured to protrude radially outward from the top groove 50 (e.g., outward along a radial axis 56) to contact the inner annular wall 44 of the cylinder 14. The top ring 54 substantially blocks the fuel/air mixture 58 from escaping from the combustion chamber 16 (e.g., during the compression stroke) and enables the expanding exhaust gasses to drive the piston 18 away from the combustion chamber 16 along a longitudinal axis 60 (e.g., during the power stroke). Furthermore, the top ring 54 may be configured to facilitate scraping oil, which coats the inner annular wall 44 and which controls heat and/or friction within the reciprocating engine, for example.

In the illustrated embodiment, the piston 18 includes a bottom annular groove 62 (e.g., bottom ring groove, bottom-most groove, or oil ring groove) extending circumferentially about the piston 18. A bottom ring 64 (e.g., bottom piston ring or oil ring) is disposed within the bottom groove 62. The bottom ring 64 may protrude radially outward from the bottom groove 62 (e.g., outward along the radial axis 56) to contact the inner annular wall 44 of the cylinder 14. The bottom ring 64 is configured to scrape oil that lines the inner annular wall 44 of the cylinder 14 and to control oil flow within the cylinder 14.

In some embodiments, one or more additional annular grooves 66 may extend circumferentially about the piston 18 between the top groove 50 and the bottom groove 62. In such embodiments, an additional ring 64 may be disposed within each additional annular groove 66. The additional ring(s) 64 may be configured to block blowby and/or to scrape oil from the inner annular wall 44 of the cylinder 14. While three rings are engaged with the piston 18 in the illustrated embodiment, in other embodiments, more or fewer rings may be engaged with the piston. For example, at least one of the top ring, the bottom ring, or the additional ring(s) may be omitted.

As illustrated, the piston 18 is attached to the crankshaft 26 via a connecting rod 68 and a pin 70. The crankshaft 26 translates the reciprocating linear motion of the piston 18 into a rotational motion. As the piston 18 moves along the longitudinal axis 60, the crankshaft 26 rotates to power the load, as discussed above. A sump or oil pan 72 is disposed below or about the crankshaft 26. In the illustrated embodiment, the sump 72 is a wet sump having an oil reservoir (e.g., for reserve oil 74). However, in other embodiments, the sump may include a dry sump configured to receive the oil, which is transferred to a remote oil reservoir via a pump.

In the illustrated embodiment, at least one intake valve 76 (e.g., 1, 2, 3, 4, or more) controls the flow of the fuel/air mixture 58 into the combustion chamber 16. In addition, at least one exhaust valve 78 (e.g., 1, 2, 3, 4, or more) controls the flow of the exhaust gasses from the cylinder 14/combustion chamber 16. In certain embodiments, the intake valve(s) 76 and the exhaust valve(s) 78 for each combustion chamber/cylinder may be controlled by one or more cam shafts, which are rotatably coupled to the crankshaft 26 (e.g., via a timing chain or a timing belt). While the valves are used to control the flow of fuel and air into the combustion chamber and to control the flow of exhaust gasses from the combustion chamber in the illustrated embodiment, in other embodiments, any suitable elements and/or techniques for providing fuel and air to the combustion chamber 16 (e.g., including direct injection of fuel into the combustion chamber) and/or for discharging exhaust gasses from the combustion chamber 16 may be utilized.

In the illustrated embodiment, the reciprocating engine is a four-stroke reciprocating engine. Accordingly, each piston 18 is configured to move through an intake stroke, a compression stroke, a power stroke, and an exhaust stroke. With regard to the intake stroke, rotation of the crankshaft 26 drives the piston 18 to move in a first direction 80 along the longitudinal axis 60. During at least a portion of the intake stroke, the intake valve(s) 76 are in the open position, thereby enabling the fuel/air mixture 58 to enter the combustion chamber 16. Continued rotation of the crankshaft 26 then drives the piston to move in a second direction 82 along the longitudinal axis 60, thereby preforming the compression stroke. The intake valve(s) 76 close slightly before initiation of the compression stroke, at the initiation of the compression stroke, or slightly after the initiation of the compression stroke. Accordingly, as the piston 18 moves in the second direction 82 during the compression stroke, the fuel/air mixture 58 is compressed within the combustion chamber 16. The spark source(s) 24 then ignite the fuel/air mixture 58, thereby initiating combustion of the fuel/air mixture 58 (e.g., at the initiation of the power stroke, slightly before initiation of the power stroke, slightly after initiation of the power stroke). As previously discussed, the combustion of the fuel/air mixture generates expanding exhaust gasses that drive the piston 18 in the first direction 80, thereby driving the crankshaft 26 to rotate during the power stroke. The exhaust valve(s) 78 open slightly before initiation of the exhaust stroke, at the initiation of the exhaust stroke, or slightly after the initiation of the exhaust stroke. During the exhaust stroke, the piston 18 moves in the second direction 82, thereby driving the exhaust gasses out of the cylinder/combustion chamber. The process disclosed above repeats during operation of the reciprocating engine for each cylinder/piston/combustion chamber.

As previously discussed, "compression" refers to the maximum pressure within the cylinder 14 during the compression stroke of the piston 18 (e.g., while the piston 18 is at top dead center within the cylinder 14). After extended operational use of the reciprocating engine, the compression within the cylinder 14 may be reduced due to formation of undesirable flow path(s) (e.g., leaks) at the cylinder 14. For example, worn piston rings may enable fluid flow between the piston 18 and the cylinder 14, worn valve(s) and/or valve seat(s) may enable fluid flow through the valve(s) while the valve(s) are closed, or a worn head gasket may enable fluid to flow between the engine block and the head.

As previously discussed, the controller 32 may determine the compression within the cylinder 14 via feedback from the respective knock sensor 38. In certain embodiments, to determine the compression of the cylinder 14, the controller 32 terminates combustion within the respective combustion chamber 16 (e.g., by terminating spark generation within the respective combustion chamber 16 and/or by terminating fuel flow into the respective combustion chamber 16) while the crankshaft 26 is rotating. Accordingly, the piston 18 moves through the four strokes disclosed above, but the combustion process is not initiated. The controller 32 then receives an input/sensor signal from the knock sensor 38 indicative of vibration within the cylinder 14 while the crankshaft 26 is rotating. Next, the controller 32 determines a magnitude of the vibration within a frequency range (e.g., between about 0 Hz and about 25 Hz). The controller 32 then determines a maximum pressure within the cylinder 14 based on the magnitude of the vibration within the frequency range, and the controller 32 outputs an output signal indicative of the maximum pressure within the cylinder 14. Because the compression monitoring system 12 is configured to determine the compression within the cylinder 14 based on feedback from the respective knock sensor 38, the compression may be monitored without physically modifying the reciprocating engine 10 (e.g., by removing the spark plug(s) and installing pressure sensor(s)). As a result, interruption in operation of the engine may be substantially reduced or eliminated. While a spark-ignition reciprocating engine is disclosed above with reference to FIGS. 1-2, in certain embodiments, the compression monitoring system disclosed herein may be employed within a compression ignition engine, in which the fuel/air mixture ignites in response to compression (e.g., during the compression stroke). In such embodiments, the spark source(s) may be omitted, and the controller may terminate combustion within a combustion chamber by terminating fuel flow to the combustion chamber.

Figure 3:
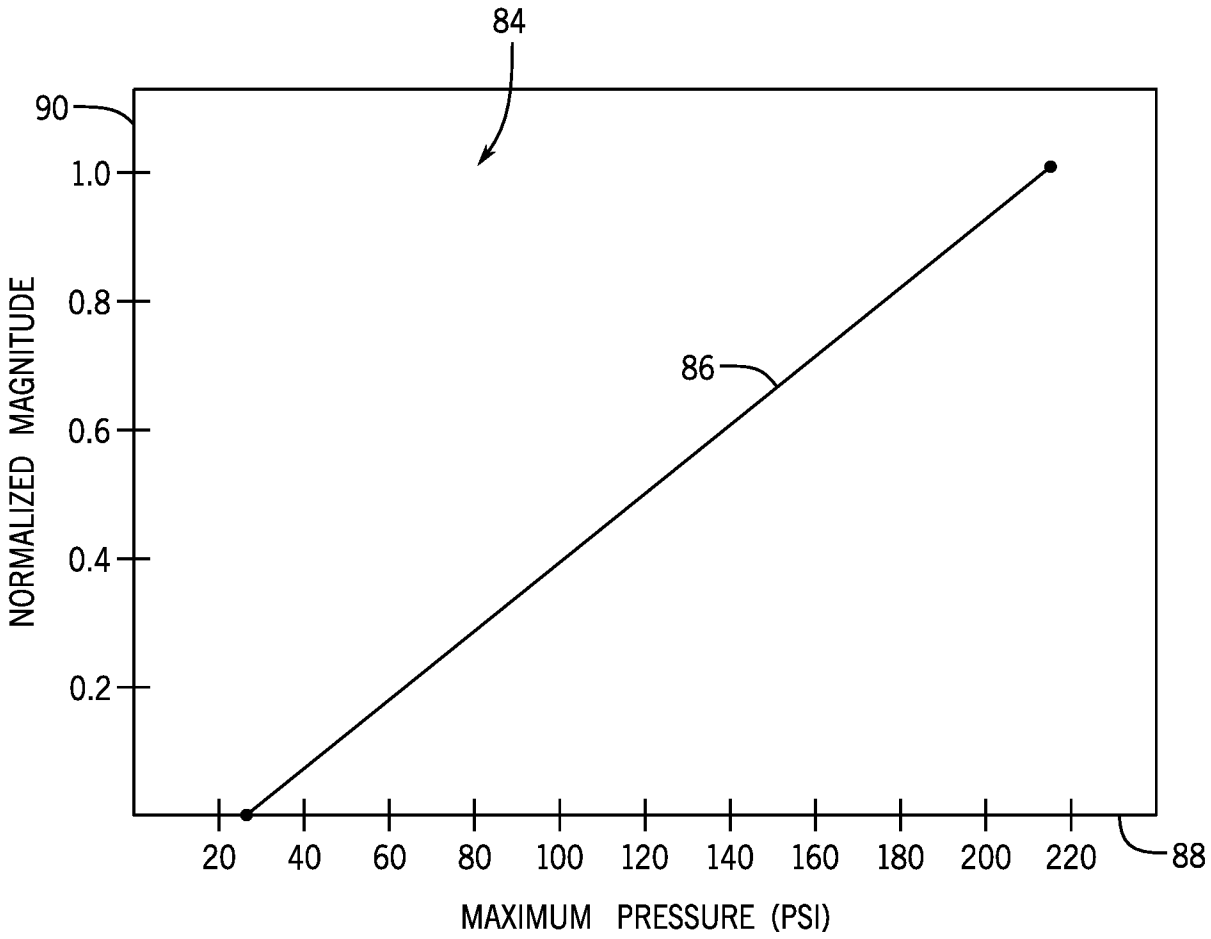
FIG. 3 is a graph of an embodiment of a pressure curve representative of maximum pressure within a cylinder of a reciprocating engine.

FIG. 3 is a graph 84 of an embodiment of a pressure curve 86 representative of maximum pressure within a cylinder of a reciprocating engine. As illustrated, the x-axis 88 of the graph 84 represents the maximum pressure within the cylinder. As previously discussed, the maximum pressure corresponds to the compression within the cylinder. In addition, the y-axis 90 represents the magnitude of the vibration within a frequency range, in which the magnitude is normalized based on a maximum vibration magnitude. As previously discussed, the vibration within the cylinder may be monitored by a respective knock sensor. The pressure curve 86 represents the relationship between the magnitude of the vibration within the frequency range and the maximum pressure within the cylinder. Accordingly, during operation of the compression monitoring system, the controller may utilize the illustrated pressure curve 86 to determine the maximum pressure within each cylinder based on the respective magnitude of the vibration within the frequency range.

In the illustrated embodiment, the frequency range is between about 0 Hz and about 25 Hz (e.g., between 0 Hz and 25 Hz). However, in other embodiments, other suitable frequency ranges may be utilized for generating the pressure curve. For example, the frequency range may include one or more selected windows within a domain between 0 Hz and 30 kHz, between 0 Hz and 10 kHz, between 0 Hz and 1 kHz, between 0 Hz and 500 Hz, or between 0 Hz and 100 Hz. Furthermore, each window may have any suitable width, such as 30 kHz, 20 kHz, 10 kHz, 5 KHz, 1 kHz, 500 Hz, 250 Hz, 100 Hz, 50 Hz, 25 Hz, 10 Hz, or 5 Hz. The pressure curve 86 may be generated (e.g., for a particular type of reciprocating engine, for a particular reciprocating engine, for a particular cylinder, etc.) by driving the crankshaft to rotate while combustion is terminated (e.g., while spark generation and/or fuel flow is terminated), monitoring the magnitude of vibration within the frequency range for a cylinder, monitoring the pressure within the cylinder, and varying the size of a fluid leak path to/from the cylinder (e.g., by manually adjusting the position of the intake valve(s) and/or the exhaust valve(s)). The pressure curve 86 may be generated during initial validation of a reciprocating engine type, during manufacturing of the reciprocating engine, during initial testing of the reciprocating engine, during a major overhaul of the reciprocating engine, or a combination thereof. The pressure curve may be stored within the memory of the controller.

While the pressure curve 86 is linear in the illustrated embodiment, in other embodiments, the pressure curve 86 may have any other suitable form (e.g., second order polynomial, third order polynomial, cubic spline, etc.). Furthermore, while the relationship between the maximum pressure within the cylinder and the magnitude of the vibration within the frequency range is represented by a curve in the illustrated embodiment, in other embodiments, the maximum pressure/vibration relationship may be represented by any other suitable type of relationship, such as a table or an empirical formula, for example. The relationship between the maximum pressure within the cylinder and the magnitude of the vibration within the frequency range may be stored within the memory of the controller, and the controller may utilize the relationship to determine the maximum pressure within the cylinder based on the magnitude of the vibration within the frequency range.

In the illustrated embodiment, the maximum pressure/vibration relationship (e.g., the pressure curve 86) is generated by rotating the crankshaft at a particular rotation rate (e.g., 140 RPM, etc.). In certain embodiments, during the compression monitoring process, the controller may receive the sensor/input signal indicative of the vibration within the cylinder while the crankshaft is rotating at the particular rotation rate (e.g., 140 RPM, etc.). For example, during the compression monitoring process, the controller may output a control signal to the starter motor to drive the crankshaft to rotate at the particular rotation rate. Furthermore, during shutdown of the reciprocating engine, the controller may receive the sensor/input signal indicative of the vibration within the cylinder in response to determining that the crankshaft is rotating at the particular rotation rate (e.g., based on feedback from a tachometer). In certain embodiments, multiple maximum pressure/vibration relationships may be determined for multiple crankshaft rotation rates. In such embodiments, the controller may select the relationship (e.g., pressure curve) corresponding to the current rotation rate of the crankshaft. Alternatively, a single maximum pressure/vibration relationship may be used for multiple (e.g., all) crankshaft rotation rates.

In certain embodiments, the controller may determine the maximum pressure within each cylinder based on the magnitude of the vibration within the frequency range alone (e.g., using the maximum pressure/vibration relationship disclosed above). However, in other embodiments, the controller may determine the maximum pressure within at least one cylinder based on the magnitude of the vibration within the frequency range and at least one other factor. For example, the at least one other factor may include engine oil temperature, engine water temperature, atmospheric pressure, age of certain engine component(s), other suitable factor(s), or a combination thereof.

Figure 4:
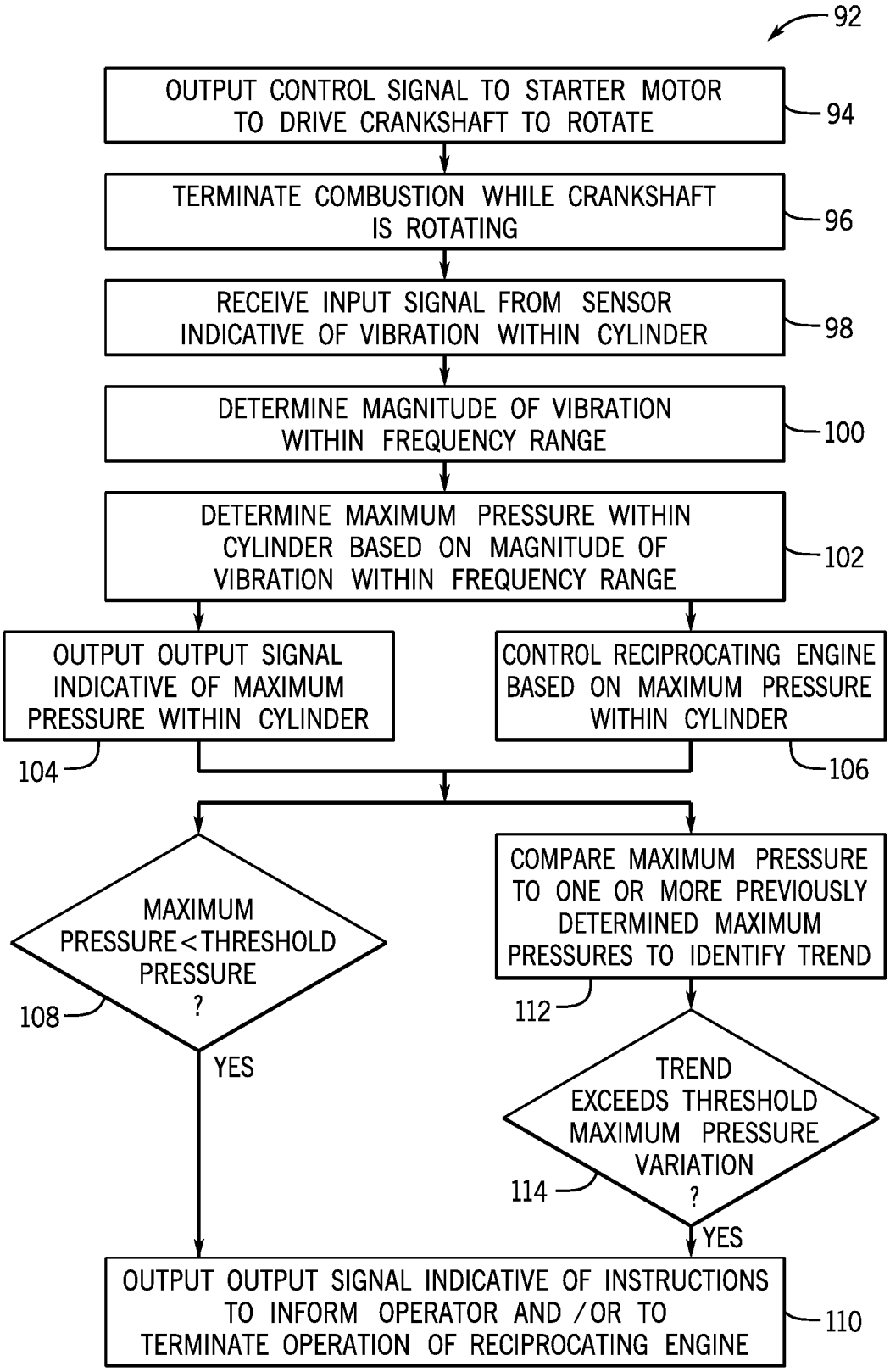
FIG. 4 is a flow diagram of an embodiment of a method for monitoring compression within a reciprocating engine.

FIG. 4 is a flow diagram of an embodiment of a method 92 for monitoring compression within a reciprocating engine. In certain embodiments, the method 92 includes outputting a control signal to a starter motor to drive a crankshaft of the reciprocating engine to rotate, as represented by block 94. For example, the control signal may be output to the starter motor during startup of the reciprocating engine and/or in response to operator input. As represented by block 96, combustion within a combustion chamber of the reciprocating engine is terminated (e.g., by terminating spark generation within the combustion chamber and/or by terminating fuel flow into the combustion chamber) while the crankshaft is rotating. As previously discussed, with the combustion terminated, the piston moves within the respective cylinder, but the combustion process is not initiated.

Next, an input signal indicative of vibration within the cylinder is received from a sensor while the crankshaft is rotating and the combustion is terminated, as represented by block 98. As previously discussed, the sensor may include a knock sensor. As represented by block 100, a magnitude of the vibration within a frequency range is determined (e.g., using a fast Fourier transformation (FFT)). As previously discussed, the frequency range may be between about 0 Hz and about 25 Hz, for example. A maximum pressure within the cylinder is then determined based on the magnitude of the vibration within the frequency range, as represented by block 102. As previously discussed, a maximum pressure/vibration relationship may be used to determine the maximum pressure based on the magnitude of the vibration. Furthermore, as previously discussed, the maximum pressure corresponds to the compression within the cylinder.

Once the maximum pressure is determined, an output signal indicative of the maximum pressure within the cylinder may be output, as represented by block 104. For example, the output signal indicative of the maximum pressure may be output to a user interface, and the user interface may present a visual indication of the maximum pressure. Additionally or alternatively, as represented by block 106, operation of the reciprocating engine may be controlled based on the maximum pressure within the cylinder. For example, operation of the reciprocating engine may be controlled based on the maximum pressure within the cylinder by adjusting at least one engine operation parameter for subsequent or current operation of the reciprocating engine. As previously discussed, the at least one engine operation parameter may include a timing of the spark generation, a flow rate of fuel into the combustion chamber, a lift and/or a duration of the intake valve(s) and/or the exhaust valve(s), a throttle setting, or a combination thereof.

In certain embodiments, the maximum pressure within the cylinder may be compared to a threshold pressure, as represented by block 108. If the maximum pressure is below the threshold pressure, an output signal indicative of instructions to inform an operator and/or to terminate operation of the reciprocating engine may be output, as represented by block 110. For example, the output signal indicative of instructions to inform the operator may be output to a user interface, and the user interface may inform the operator that the maximum pressure is less than the threshold pressure (e.g., via a visual indication on a display). Furthermore, the output signal indicative of instructions to terminate operation of the reciprocating engine may be output to each fuel injector and/or each spark source, thereby terminating operation of the reciprocating engine. As a result, if the compression monitoring method is performed during startup of the reciprocating engine, the startup process may be terminated.

Furthermore, in certain embodiments, the maximum pressure within the cylinder may be compared to one or more previously determined maximum pressures to identify a trend, as represented by block 112. Next, as represented by block 114, the trend may be compared to a threshold maximum pressure variation. If the trend exceeds the threshold maximum pressure variation, the output signal indicative of instructions to inform the operator and/or to terminate operation of the reciprocating engine may be output, as represented by block 110. As previously discussed, the threshold maximum pressure variation may include a maximum slope of a maximum pressure/sample line (e.g., a linear curve fit of the maximum pressure samples). For example, if the maximum pressure is decreasing faster than the threshold maximum pressure variation over multiple samples, the output signal indicative of the instructions to inform the operator and/or to terminate operation of the reciprocating engine may be output.

While the compression monitoring method 92 is disclosed above with reference to one cylinder, at least a portion of the method may be repeated for all cylinders or a portion of the cylinders within the reciprocating engine. For example, the steps corresponding to blocks 96-114 may be repeated (e.g., serially, in parallel, or a combination thereof) for each cylinder. Furthermore, the steps of the method 92 may be performed in the order disclosed herein or in any other suitable order. In addition, in certain embodiments, the method 92 is performed by the controller of the compression monitoring system. However, in other embodiments, the method 92 may be performed by any other suitable controller.

While only certain features have been illustrated and described herein, many modifications and changes will occur to those skilled in the art. It is, therefore, to be understood that the appended claims are intended to cover all such modifications and changes as fall within the true spirit of the disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A compression monitoring system for a cylinder of a reciprocating engine, comprising:

a sensor operable to generate a sensor signal indicative of vibration within the cylinder;

a controller connected in communication with the sensor, the controller comprising a memory and a processor, wherein the memory includes program instructions for execution by the processor to perform the following:

terminating combustion within a combustion chamber extending to the cylinder during rotation of a crankshaft of the reciprocating engine for at least one complete four-stroke cycle of a piston within the cylinder;

receiving the input signal from the sensor indicative of the vibration within the cylinder during rotation of the crankshaft and termination of the combustion;

determining a magnitude of the vibration within a frequency range;

determining a maximum pressure within the cylinder based on the magnitude of the vibration within the frequency range; and generating an output signal indicative of the maximum pressure within the cylinder.

2. The compression monitoring system of claim 1, wherein the sensor comprises a knock sensor.

3. The compression monitoring system of claim 1, wherein the memory includes program instructions for execution by the processor to perform the following:

outputting a control signal to a starter motor to drive the crankshaft of the reciprocating engine to rotate.

4. The compression monitoring system of claim 1, wherein terminating the combustion within the combustion chamber is performed during startup or shutdown of the reciprocating engine.

5. The compression monitoring system of claim 1, wherein the memory includes program instructions for execution by the processor to perform the following:

controlling operation of the reciprocating engine based on the maximum pressure within the cylinder.

6. The compression monitoring system of claim 5, wherein controlling operation of the reciprocating engine comprises adjusting at least one engine operation parameter for subsequent operation of the reciprocating engine.

7. The compression monitoring system of claim 1, wherein the memory includes program instructions for execution by the processor to perform the following:

comparing the maximum pressure within the cylinder to a threshold pressure; and outputting a second output signal indicative of at least one of the following in response to determining that the maximum pressure is below the threshold pressure: instructions to inform an operator, or instructions to terminate operation of the reciprocating engine.

8. The compression monitoring system of claim 1, wherein the memory includes program instructions for execution by the processor to perform the following:

comparing the maximum pressure to one or more previously determined maximum pressures to identify a trend; and outputting a second output signal indicative of at least one of the following in response to the trend exceeding a threshold maximum pressure variation: instructions to inform an operator, or instructions to terminate operation of the reciprocating engine.

9. A method for determining compression within a cylinder of a reciprocating engine, comprising:

terminating, via a controller comprising a memory and a processor, combustion within a combustion chamber extending to the cylinder while a crankshaft of the reciprocating engine is rotating and for at least one complete four-stroke cycle of a piston within the cylinder;

receiving, via the controller, an input signal from a sensor indicative of vibration within the cylinder while the crankshaft is rotating and the combustion is terminated;

determining, via the controller, a magnitude of the vibration within a frequency range;

determining, via the controller, a maximum pressure within the cylinder based on the magnitude of the vibration within the frequency range; and outputting, via the controller, an output signal indicative of the maximum pressure within the cylinder, controlling, via the controller, operation of the reciprocating engine based on the maximum pressure within the cylinder, or a combination thereof.

10. The method of claim 9, wherein the sensor comprises a knock sensor.

11. The method of claim 9, comprising controlling operation of the reciprocating engine based on the maximum pressure within the cylinder by adjusting at least one engine operation parameter for subsequent operation of the reciprocating engine.

12. The method of claim 9, comprising outputting, via the controller, a control signal to a starter motor to drive the crankshaft of the reciprocating engine to rotate.

13. The method of claim 9, wherein terminating the combustion within the combustion chamber of the reciprocating engine is performed during startup or shutdown of the reciprocating engine.

14. The method of claim 9, comprising:

comparing, via the controller, the maximum pressure within the cylinder to a threshold pressure; and outputting, via the controller, a second output signal indicative of instructions to inform an operator, to terminate operation of the reciprocating engine, or a combination thereof, in response to the maximum pressure being below the threshold pressure.

15. The method of claim 9, comprising:

comparing, via the controller, the maximum pressure to one or more previously determined maximum pressures to identify a trend; and outputting, via the controller, a second output signal indicative of instructions to inform an operator, to terminate operation of the reciprocating engine, or a combination thereof, in response to the trend exceeding a threshold maximum pressure variation.

16. A compression monitoring system for a reciprocating engine, comprising:

a controller comprising a memory and a processor, wherein the controller is configured to:

terminate combustion within a combustion chamber extending to a cylinder of the reciprocating engine while a crankshaft of the reciprocating engine is rotating and for at least one complete four-stroke cycle of a piston within the cylinder;

receive an input signal from a sensor indicative of vibration within the cylinder while the crankshaft is rotating and the combustion is terminated;

determine a magnitude of the vibration within a frequency range;

determine a maximum pressure within the cylinder based on the magnitude of the vibration within the frequency range; and output an output signal indicative of the maximum pressure within the cylinder, control operation of the reciprocating engine based on the maximum pressure within the cylinder, or a combination thereof.

17. The compression monitoring system of claim 16, wherein the controller is configured to control operation of the reciprocating engine based on the maximum pressure within the cylinder by adjusting at least one engine operation parameter for subsequent operation of the reciprocating engine.

18. The compression monitoring system of claim 16, wherein the frequency range is between 0 Hz and 25 Hz.

19. The compression monitoring system of claim 16, wherein the controller is configured to output a control signal to a starter motor to drive the crankshaft of the reciprocating engine to rotate.

20. The compression monitoring system of claim 16, wherein the controller is configured to terminate the combustion within the combustion chamber during startup or shutdown of the reciprocating engine.

* * * * *